United States Patent [19]

Gämmerler

[11] Patent Number: 4,844,442

[45] Date of Patent: Jul. 4, 1989

[54] APPARATUS FOR CHANGING THE CONVEYING DIRECTION OF PAPER PRODUCTS OR THE LIKE

[76] Inventor: Gunter Gämmerler, Ichoring 44, D-8021 Icking, Fed. Rep. of Germany

[21] Appl. No.: 262,080

[22] Filed: Oct. 24, 1988

Related U.S. Application Data

[63] Continuation of Ser. No. 40,178, Apr. 19, 1987, abandoned.

[30] Foreign Application Priority Data

Apr. 25, 1986 [DE] Fed. Rep. of Germany ..... 3614103

[51] Int. Cl.[4] ..... B65H 5/02

[52] U.S. Cl. ..... 271/225; 271/186; 226/197

[58] Field of Search ..... 271/184–186, 271/225; 226/197

[56] References Cited

U.S. PATENT DOCUMENTS

| | | | |
|---|---|---|---|
| 344,352 | 6/1886 | Crowell | 226/197 |
| 3,583,621 | 6/1971 | Bryant | 226/197 X |
| 3,671,035 | 6/1972 | Reist | 271/185 |
| 4,062,537 | 12/1977 | Dietrich | 271/185 X |
| 4,078,489 | 3/1978 | Davis | 271/184 X |
| 4,330,116 | 5/1982 | Newsome | 271/185 X |
| 4,687,125 | 8/1987 | Hashimoto | 226/197 X |

*Primary Examiner*—Richard A. Schacher
*Attorney, Agent, or Firm*—Paul L. Sjoquist

[57] ABSTRACT

In an apparatus for changing the conveying direction of bendable paper products brought up continously in formation said products are clamped in a constraining guide in fixed formation, turned at least partially helically and led at an angle to the feed direction.

15 Claims, 5 Drawing Sheets

APPARATUS FOR CHANGING THE CONVEYING DIRECTION OF PAPER PRODUCTS OR THE LIKE

Figure 1:
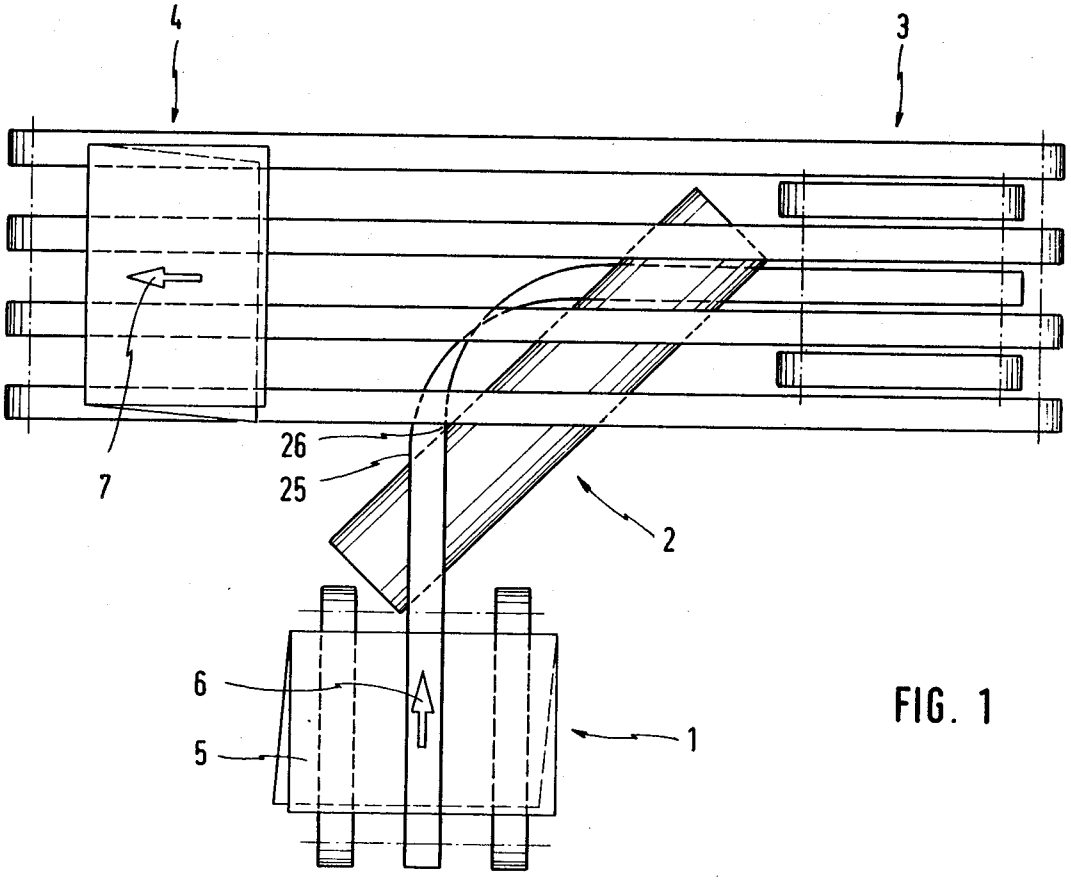

This is a continuation of U.S. Pat. application Ser. No. 040,178, filed Apr. 19, 1987, and now abandoned.

The invention relates to an apparatus for changing the conveying direction of bendable paper products or the like brought up continuously in formation, in particular shingled at least two-layer paper products lying on each other.

Numerous apparatuses are known for deflecting the product flow into another direction, e.g. at right-angles to the feed direction, which consist of individual rods, possibly with suction pads, and which carry away at a right-angle the paper products for example shingled that is overlapping formations. The paper products are thus turned through 90° with respect to the conveying axis.

So-called turning conveyors are known in which the singled-out paper products are advanced by holders on a chain drive and conveyed away in any desired other direction.

In all these cases either the formation of the paper products is changed, whether they be brought up individually or in shingled or at least the tolerances of the individual overlappings or also the intervals of the individual paper products are changed within large limits; a certain tilting of the individual paper products on depositing the latter from the chain conveyor is also possible.

The present invention is based on the problem of providing a possibility of deflecting the formation of paper products unchanged into another direction and possibly turning the individual paper products.

This problem is solved according to the invention in that the paper products are clamped fixed in formation in a constraining guide, at least partially turned helically and guided at an angle to the feed direction.

The turning normally through 180° of the products, whether in shingled formation or single formation, makes it possible to treat the back of the individual products, for example provide it with adhesive, labels or the like, or also possibly after the arrangement of a turner-back to cause the formations to continue in the same form in which the products were delivered by the feed conveyor; the direction of the individual paper products with respect to the conveying axis is not changed. By the clamping in the constraining or forced guide the paper products are held so firmly on guiding about the turning axis that formation stability is ensured.

The apparatus possibly constructed as independent unit can either replace guide means in existing machines or can be used in a new machine, for example a rotary cutting machine.

According to a preferred embodiment of the invention the constraining guide consists of at least one conveyor belt engaging the paper products from above or below and a helical backup or abutment. The backup may consist of a helical conveyor belt or comprise the latter.

According to a modified embodiment the abutment or backup consists of a helical guide, for example a correspondingly bent rail, strip or the like, or comprises the latter. The constraining or forced guide can also consist of separate pulleys, rollers or the like disposed helically on a support.

In all the embodiments at least one conveyor belt and/or the pulleys, rollers or the like is or are driven.

Expediently, at least one conveyor belt is provided at its product-remote side with projections, lateral borders or the like and the conveyor belt guide correspondingly formed.

By using two conveyor belts or also otherwise formed possibly resilient backups it is possible not only to transport single-layer paper products, for example in stream or overlapping formation, without mechanical changes being made to the apparatus.

The constraining guide may consist of a helical bead or the like formed or disposed on a support. The pulley, roller or bead carrier is preferably made circular or polygonal in cross-section; in the latter case the support may possibly be mounted stationary in the form of a cylinder.

The pulley or roller support preferably comprises holes for rotatable receiving of pulley or roller holders. These for example U-shaped holders provided with a pin may then be adjusted for exact guiding of the conveyor belt.

The conveyor belt, the pulleys, rollers or the bead may be at the most 15 cm wide; in the feed conveyor lateral strips, guides or the like may be provided for the paper products.

Particularly expedient is an embodiment in which the entrance of the single constraining or forced guide is disposed centrally between the edges of the feed conveyor.

The angle of the helical constraining guide between the feed conveyor and exit conveyor is expediently twice as large as the angle between the turning axis and the feed conveyor.

The apparatus according to the invention may also be amplified in that the turning means or turner is followed by a turning-back means or turner-back with formation-fixed clamping of the paper products.

The turner-back may consist of at least two conveyor belts extending parallel at least in the contact region with the paper products. In this case as well the paper products are held fixed in position or formation to such an extent that the paper products leaving the turner-back assume exactly the same position as before the feed conveyor as regards their position and respective spacing from the adjacent paper products.

The two conveyor belts are guided round at least three rollers. At least one conveyor belt and/or the constraining guide consisting of pulleys or rollers or comprising the latter may be driven.

According to a particularly expedient embodiment the turner-back is constructed as overhead conveyor.

The exit conveyor of the turner-back may be disposed above the turning means. In this manner not only a particularly compact apparatus is obtained but it is additionally possible to make and deliver the turning means and guide means as module and to connect to said module the turner-back, likewise constructed as independent module.

In the drawings an example of embodiment of the invention is shown in conjunction with an attachment or auxiliary device; it will be described in detail hereinafter.

Figure 2:
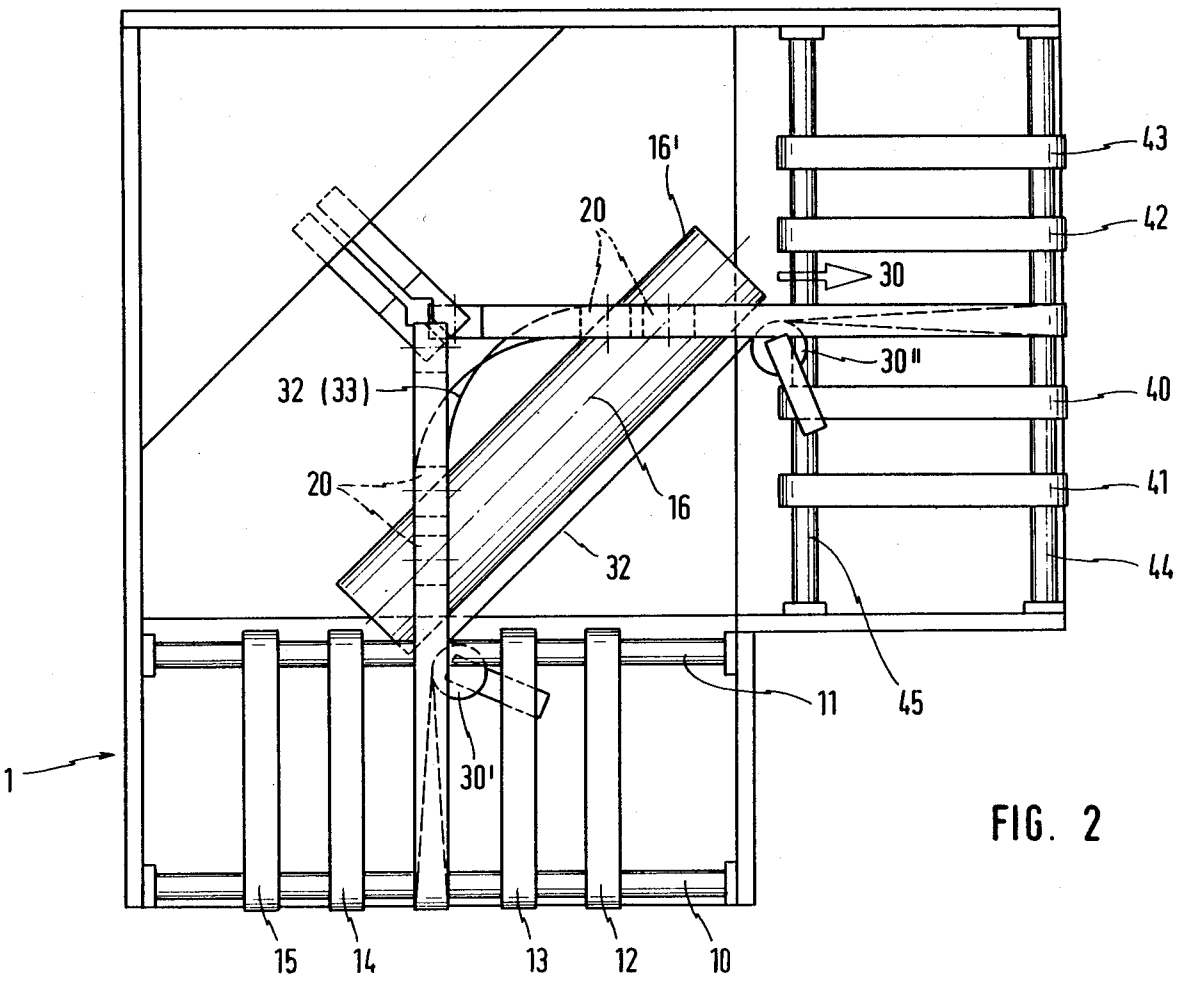
Figure 3:
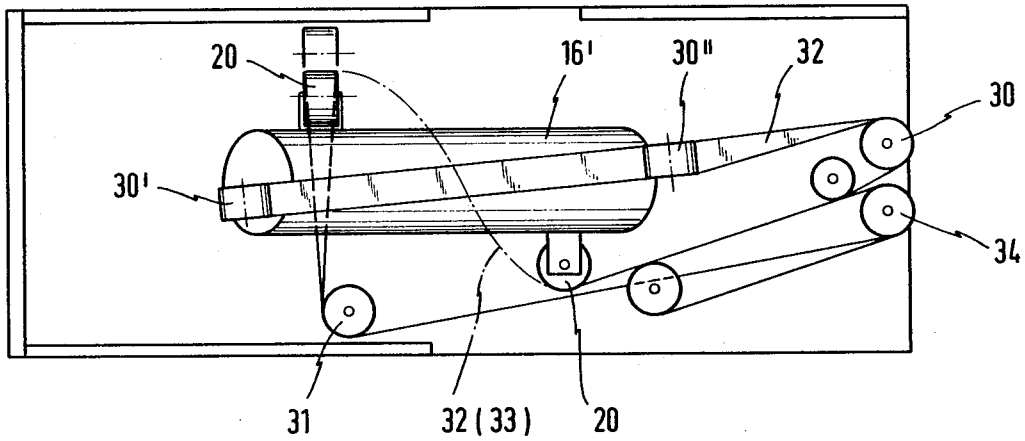
Figure 4:
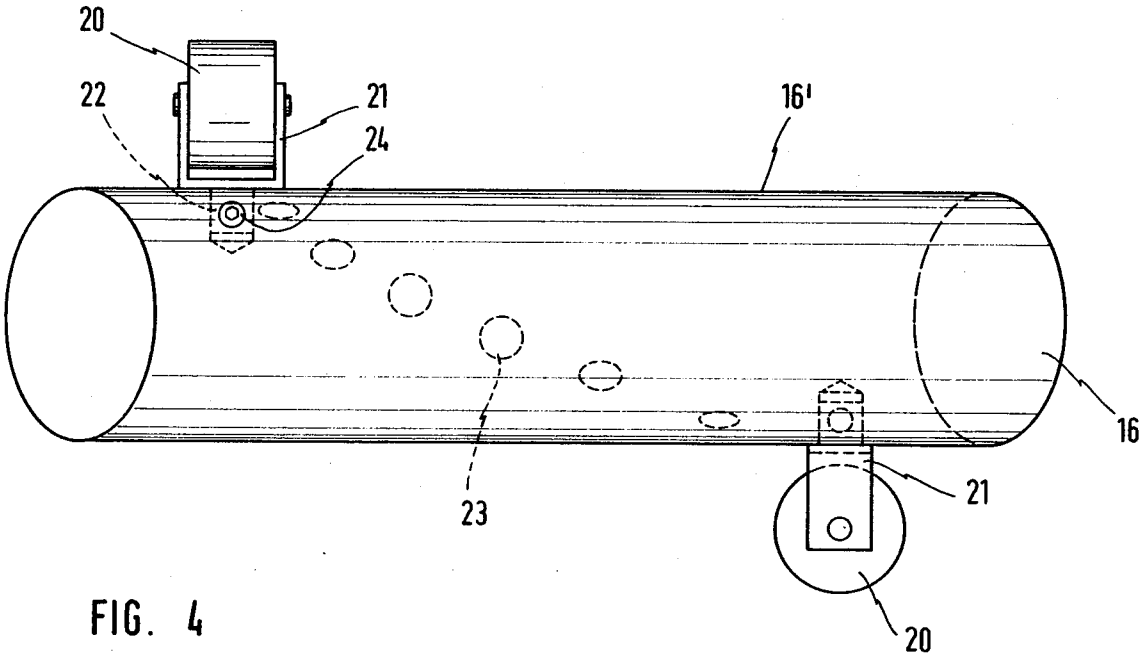
Figure 5:
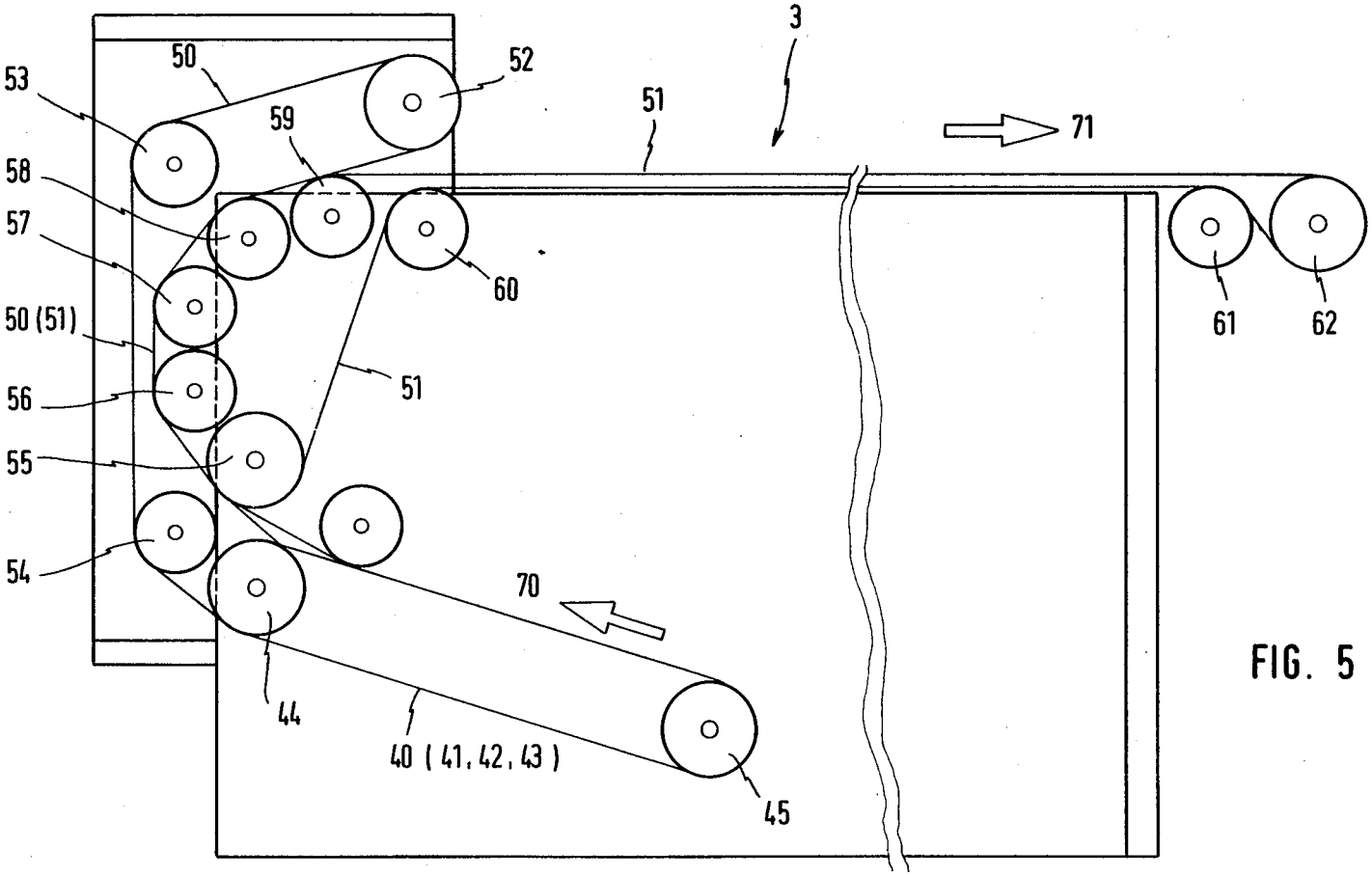

FIG. 1 shows a basic sketch of the apparatus according to the invention with attachment, FIG. 2 is a plan view of the apparatus according to the invention in schematic illustration, FIG. 3 is a detail of the embodiment of the invention illustrated in FIG. 2, FIG. 4 is a further detail and FIG. 5 is a longitudinal section through the attachment in laterally inverted identical schematic illustration.

Following a feed conveyor 1 a turning means 2 is disposed which is followed by the turner-back 3 and the exit conveyor 4. The single paper product 5 represented in the example of embodiment is shown as first-folded double page and is brought up in the direction of arrow 6 and conveyed away in the direction of the arrow 7. The intermediate turning and turning-back of the paper product will be described in detail hereinafter; the paper product assumes however after leaving the exit conveyor exactly the same position with respect to the conveying direction and the adjacent paper products, whether single or in shingled feed, as in the feed conveyor.

The feed conveyor 1 consists for example of two rollers 10, 11 which are connected together by four endless conveyor belts 12, 13, 14 and 15. Possible lateral guides, strips or the like adapted to the width of the paper products delivered are not illustrated.

The axis 16 of the turning means or turner 16' extends at an angle of 45° to the feed conveyor axis.

The turner 16' consists in the embodiment illustrated of a cylinder which is fixedly connected to the frame of the module and on which the rollers 20 shown in more detail in FIG. 4 are disposed.

In the embodiment illustrated a total of eight roller 20 is provided which are distributed in cylindrical form over 180 arc degrees with respect to the turning axis 16. Whereas the axis of the first roller 20 extends perpendicularly to the feed conveyor direction 6 the axis of the eighth feed conveyor roller 20 extends perpendicularly to the exit conveyor axis 7.

In accordance with the illustration of FIG. 2 the first roller 20 lies on the side of the turner 16' facing the observer whilst the last roller 20 lies on the remote side. The six rollers 20 disposed therebetween are distributed over the periphery of the cylinder 16 in such a manner that they establish a helical connection between the first and last rollers. The rollers 20 are made free-running in the embodiment illustrated and rotatably mounted in U-shaped holders 21. The U-shaped holders each have a pin-shaped extension 22 which is held in a corresponding hole 23 in the cylindrical turner 16' by a lock screw 24; the lock screw 24 permits rotation of the holder 21 to adapt the latter to the necessary guiding of a conveyor belt in helical form. The helical form is indicated in FIG. 1 with the two lines 25, 26. The paper product brought up by the feed conveyor is clamped in the region of the turning means 2 between two parallel conveyor belts in the width of the rollers 20 so that the individual paper products can be turned without changing their formation or position and conveyed away in the direction of the arrow 30; as described in detail hereinafter they can then be turned back by an overhead conveyor and possibly supplied in the direction of the arrow 7 to a further treatment station.

The turning means is employed by the constraining guide between the two conveyor belts, which for example are driven synchronously, in such a manner that a turning of the individual products or the stream formation through 180° is effected, the individual products lying at the level of the arrow 30 with their upper side downwards.

The eight rollers provided for example thus effect not only a deflecting of the product flow through 90° but also a turning over of the individual products each through 180° so that in a treatment station following substantially directly the lower side of the paper products can be treated, for example by applying adhesive, sticking on labels, or the like, or a possible partial vacuum can be exerted on the reverse side.

As shown schematically in FIG. 3 the two belts run jointly over each other from the first roller 20 helically up to the last roller 20, the upper belt 32 running from a driven roller 30 above the lower conveyor belt 33 to be described subsequently and the eight rollers 20 to the rolls 30', 30'', the belt region on this side of the turner 16' being indicated in plan view with dashed line and the region running over the rollers 20 being indicated by a dot-dash line.

The lower conveyor belt 33 runs from the roller 34 directly over the rollers 20 (dot-dash line) to the reversal roller 31 and back to the roller 34.

As already pointed out the two conveyor belts are led directly over each in the region of the rollers 20 but are so resilient that to a certain degree they can adapt themselves to the thickness of the conveyed paper products, whether they are single-layer or multilayer.

The laterally inverted identical illustration in FIG. 5 in longitudinal section shows diagrammatically the return conveyor 3 having four conveyor belts 40, 41, 42 and 43 which as endless conveyors run round the rollers 44 and 45.

The turning axis 16 would have to be changed according to FIG. 5 by 90° for adaptation to the return conveyor 3 and the arrow direction 30 would also run in the opposite direction to match the section of the return conveyor according to FIG. 5.

Whereas in the illustration of FIG. 2 the roller 44 lies on the outer right and is disposed higher than the roller 45, in the embodiment according to FIG. 5 the arrangement is the converse (identically laterally inverted).

In the return conveyor as well two parallel running conveyor belts 50, 51 are provided, the upper conveyor belt 50 being led round a deflection roller 52, an outer upper roller 53 and a lower roller 54 as well as the roller 44.

In the contact region with the paper products the upper conveyor belt runs with the corresponding lower conveyor belt but round the rollers 55, 56, 57, 58 and 59 and then back to the deflection roller 52.

The lower conveyor belt 51 also runs, in this case directly, onto the rollers 55 to 59 and the roller 55 is constructed as reversal roller. The conveyor belt 51 then runs over the further reversal roller 60 to the roller 61 and then to the driven reversal roller 62.

The two conveyor belts may consist of individual narrow conveyor belt strips; the conveyor belt strips, for example five in number, must however be arranged so that they run over each other in pairs in the region of the clamping of the individual products.

As already mentioned the return conveyor can be constructed as independent module or as independent unit and be used together with the turning means described above. In this case the individual products are supplied in the arrow direction 70 and carried away in the arrow direction 71.

In the assembly of this module with the turner according to FIG. 2 the arrow direction 30 corresponds to the arrow 70 in FIG. 5 whilst the arrow 71 must run in the opposite direction. On assembly with the embodiment according to FIG. 2 of the turner the deflecting rollers 44 and 52 to 60 must therefore not be arranged on the left side as illustrated in FIG. 5 but on the right side of the drawings, i.e. above the conveyor belts 40 to 43. Since the conveying away as illustrated in FIG. 1 would take place in the direction 7 the latter runs above the turner 16 or 16' and is thus accommodated in correspondingly compact manner.

The helical constraining guide, that is in the embodiment illustrated the rollers and the two conveyor belts, are disc tributed in the turning region over an arcuate angle of 180° corresponding to a turning of the individual products over from their top to their bottom side. Of course, a greater number of rollers may be provided and the turning of the products may be larger or smaller by changing the arcuate angle.

The angle which the turning axis 16 includes with the feed conveyor or feed means 6 can be variable, thereby changing the corresponding exit direction.

I claim:

1. Apparatus for changing the conveying direction of bendable paper products or the like brought up continuously in formation, in particular shingled at least two-layer paper products lying on each other, characterized in that the paper products are clamped fixed in formation in a constraining guide, comprising conveying belts having a first direction of travel; a fixed support aligned in a direction different from said first direction of travel, said support carrying a plurality of rollers sequentially mounted along a helical line about said support; and means for guiding said conveying belts over said plurality of rollers, said conveying belts thereby adopting a second direction of travel.

2. Apparatus according to claim 1, characterized in that at least one conveyor belt is provided at its product-remote side with projections, and the means for guiding is corresponding formed.

3. Apparatus according to claim 2, characterized in that each of said rollers is circular in cross-section.

4. Apparatus according to claim 3, characterized in that the support is stationarily mounted in the form of a cylinder.

5. Apparatus according to claim 4, characterized in that the support has holes along a helical line, and further comprising a plurality of roller holders mounted in said holes, said roller holders each rotatably supporting a roller.

6. Apparatus according to any claim 5, characterized in that the conveyor belt and the rollers are less than 15 cm wide.

7. The apparatus of claim 1, further comprising a feed conveyor aligned with said first direction of travel.

8. The apparatu of claim 7, wherein said constraining guide comprising two conveying belts is centrally aligned with said feed conveyor at an entrance point to said rollers mounted on said fixed support.

9. The apparatus of claim 8, further comprising an exit conveyor aligned with said second direction of travel.

10. The apparatus of claim 9, wherein said exit conveyor further comprises means for creating a third direction of travel which is the reverse of said second direction of travel.

11. The apparatus of claim 10, wherein said means for creating a third direction of travel further comprises at least two conveyor belts extending parallel with said second direction of travel.

12. The apparatus of claim 11, further comprising at least three rollers aligned for guiding each of said at least two conveyor belts.

13. The apparatus of claim 11, wherein said means for creating a third direction of travel is disposed above said exit conveyor.

14. Apparatus according to claim 9, characterized in that the angle between the feed and exit conveyor is twice as large as the angle between the fixed support and the feed conveyor.

15. The apparatus of claim 1, further comprising means for driving said two conveying belts over said plurality of rollers.

* * * * *